United States Patent [19]

Ishida et al.

[11] 4,397,246

[45] Aug. 9, 1983

[54] PALLETS MADE OF SYNTHETIC RESINS

[75] Inventors: Nobuhiro Ishida; Ikuo Sukekawa; Shigeo Yasuda; Yoshikazu Yoshida, all of Yokohama, Japan

[73] Assignees: Kirin Beer Kabushiki Kaisha; Mitsubishi Kasei Kogyo Kabushiki Kaisha, both of Tokyo, Japan

[21] Appl. No.: 792,851

[22] Filed: May 2, 1977

[51] Int. Cl.[3] ..... B65D 19/18; B32B 3/30

[52] U.S. Cl. ..... 108/55.3; 248/346; 428/163; 428/167; 108/901

[58] Field of Search ..... 428/163, 167, 188, 172, 428/173, 156, 494, 492; 108/901, 902, 51.1, 55.3; 16/1; 248/346

[56] References Cited

U.S. PATENT DOCUMENTS

| | | | |
|---|---|---|---|
| 2,288,470 | 6/1942 | Lorraine | 16/10 |
| 2,366,209 | 1/1945 | Morris | 428/167 |
| 3,430,585 | 3/1969 | Grant et al. | 108/51.1 |
| 3,677,200 | 7/1972 | Coccagna et al. | 108/901 |
| 3,814,778 | 6/1974 | Hosoda et al. | 108/901 |
| 3,951,078 | 4/1976 | Fowler et al. | 108/901 |
| 4,051,787 | 10/1977 | Nishitani et al. | 108/51.1 |

*Primary Examiner*—Paul J. Thibodeau

*Attorney, Agent, or Firm*—Oblon, Fisher, Spivak, McClelland & Maier

[57] ABSTRACT

A synthetic resin pallet is provided with at least one slip preventing member on the upper and or lower surfaces of the deck board. The slip preventing member is made of relatively soft and flexible material, preferably a polyolefin resin.

16 Claims, 4 Drawing Figures

PALLETS MADE OF SYNTHETIC RESINS

BACKGROUND OF THE INVENTION

This invention relates to a pallet made of a synthetic resin wherein slip preventing members are provided for the deck board of the pallet.

Synthetic resin pallets are now widely used in many applications, because their water absorption is small, can be cleaned readily and sanitary, can be produced by mass production technique to have a stable quality and definite dimensions and shape and because they are free from any splinter or hangnail inherent to pallets made of wood. However, synthetic resin pallets are not advantageous in that they are slippery thus causing rupture or damage not only to the pallets themselves but also goods mounted thereon.

For example, when conveying synthetic resin pallets by a chain or roller conveyor or a fork lift they are liable to slip on such conveyors so that the stability of stacked pallets is lost. Especially when pallets are lowered along inclined conveyors installed in warehouses or the like, the descending speed of the pallets increases acceleratedly. In such a case, it is difficult to control the speed of the pallets with the result that they collide with each other. Moreover, when the pallets are stopped, the goods becomes unstable due to moment of inertia and often fall down.

To prevent such slippage it has been the practice to form irregularities on the deck board at the time of moulding a pallet, or to form opening in the deck board after moulding for inserting rubber projections. With such slip preventing members, it has been difficult to effectively prevent slippage according to the type and shape of the goods and the type, shape and method of operation of the conveyor system.

Alternatively, a flat rubber sheet having a large coefficient of friction was bonded to the pallet. However, when the pallet is made of a polyolefin resin, for example, the bonding property is poor so that the rubber sheet tends to peel off. Prevention of slippage involves problems that can not be solved by the coefficient of friction alone. More particularly, if the coefficient of friction were too high, when the pallets are subjected to a shock the goods can not slide so that the stacked goods would fall down as a column.

SUMMARY OF THE INVENTION

It is an object of this invention to provide an improved pallet made of a synthetic resin capable of manifesting slip preventing property over a long time and suitable for handling relatively hard goods such as crates containing bottles, petroleum cans or the like and can be conveyed by any type of conveyors.

Another object of this invention is to provide an improved synthetic resin pallet suitable to descend along inclined conveyors.

According to this invention there is provided a pallet made of a synthetic resin and provided with a plurality of cord shaped slip preventing members on the upper and or lower surfaces of the deck board, the slip preventing members being made of relatively soft and flexible material.

The slip preventing members deform slightly to prevent excessive slippage when goods are loaded on the pallet or when the pallet is loaded on a roller conveyor.

DESCRIPTION OF THE PREFERRED EMBODIMENTS

Figure 1:
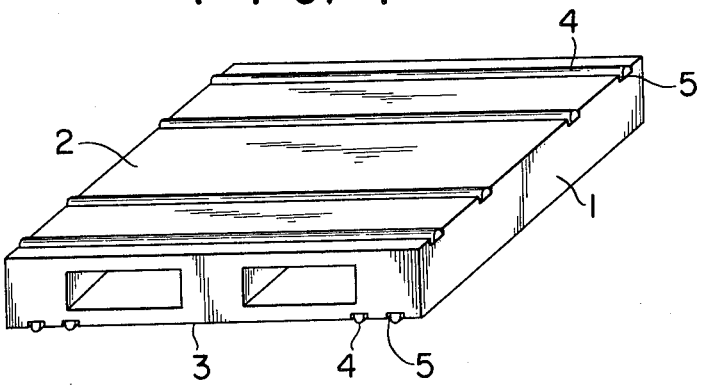
FIG. 1 is a perspective view of one example of a two-way entry pallet embodying the invention.

The synthetic resin utilized to prepare the pallet of this invention may be any one of many known synthetic resins. Among these resins may be mentioned polyolefine resins such as high density polyethylenes (having a density of from 0.95 to 0.98), polypropylenes and ethylene-propylene copolymers; vinyl chloride resins such as polyvinyl chlorides and polyvinylidene chlorides; styrene resins such as polystyrenes, acrylonitrile-styrene copolymers, and acrylonitrile-butadiene-styrene terpolymers; polyamide resins; and polyester resins. Of these polyolefine resins, particularly polyethylenes are preferred in view of their physical characteristics and economy of the pallet.

These raw material resins may be incorporated with an antioxidant, a ultraviolet ray absorbing agent, a foaming agent, a dye, a pigment, an inorganic filler such as cellulose fibers, and an inorganic filler such as glass fibers, calcium carbonate and talc. From the standpoint of weight, physical properties and economy it is advantageous to form the pallet with a foamed polyolefine resin.

The synthetic resin pallet of this invention can be prepared by any moulding method, for example, injection moulding, blow moulding, rotational moulding, vacuum forming and casting.

It is also possible to combine extruded plates into a pallet. The pallet may be constructed as the two-way entry type or four-way entry type.

The synthetic resin pallet is provided with a plurality of longitudinal or transverse grooves on its deck board surface for receiving slip preventing members as will be described later. The grooves may be formed at the time of moulding the pallet or may be formed later by cutting or milling.

The slip preventing member utilized in this invention takes the form of a cord such as a ribbon or tape and can be made of any relatively soft and flexible material that properly deforms under a load or when engaged by conveyor rollers. Further, it is advantageous that the material can be welded. Suitable materials are, for example, low density polyethylenes having a density of from 0.91 to 0.93, ethylene-vinyl acetate copolymers, ethylene-ethylacrylate-copolymers, and thermoplastic rubbers or mixtures thereof. When an ethylene-vinyl acetate copolymer alone or an ethylene-ethylacrylate copolymer alone is formed into a cord for use as the slip preventing member, the former copolymer contains up to 30% by weight of vinyl acetate while the latter copolymer contains up to 15% by weight of ethylacrylate. When blended with a low density polyethylene there is no limit for the content of vinyl acetate or ethylacrylate. However, it is advantageous to use copolymers just described. Also, there is no limit on the ratio of the low density polyethylenes and copolymers.

The thermoplastic rubber is not used singly as a cord but usually blended with a low density polyethylene or said copolymers at a ratio of less than 30% by weight of the thermoplastic rubber based on the weight of the blend. The term "thermoplastic rubber" used herein means a block copolymer of an amorphous polymer (thermoplastic) having a glass transition point of higher than room temperature and an amorphous polymer (rubber) having a glass transition point of lower than room temperature. Generally, polystyrene-polybutadien-polystyrene (—S—B—S) and polystyrene-polyisoprene-polystyrene are suitable for use as the thermoplastic rubber. Among thermoplastic rubbers available on the market may be mentioned Cariflex (manufactured by Shell Kagaku Kabushiki Kaisha) and Tuftremen (manufactured by Asahi Chemical Industry Co., Ltd.).

The slip preventing member utilized in this invention takes the form of a cord made of relatively soft and flexible material described above. Such cord may be prepared by extruding the soft and flexible material or cutting an extruded sheet of the material into tapes. Usually, the slip preventing members have a length substantial equal to the width or length of the deck board of the pallet. It is also possible to install shorter sections of the cord with a gap therebetween. The cross-sectional configuration of the slip preventing member may be circular, rectangular or any other shape, and the dimension thereof is determined in accordance with the softness and flexibility of the slip preventing member, the weight of the load and other factors. For example, is the case of a slip preventing member made of an ethylene-vinyl acetate copolymer containing 14%, by weight, of vinyl acetate and having a melt index (MI) of 1.4 and a rectangular cross-section, a width of 10 to 15 mm and a thickness of 0.5 to 3 mm, preferably 1 to 2 mm are effective to provide a desired slip preventive property. Where the deck board surface is provided with grooves and the slip preventing members are received therein it is necessary to increase the thickness of the slip preventing member by at least the depth of the grooves.

The synthetic resin pallet of this invention is provided with above described cord shaped slip preventing members on the upper and or lower surfaces of the deck board. The number of the slip preventing members varies depending upon the shape and weight of the load where the slip preventing members are provided for the upper surface of the deck board, whereas in the case of the lower surface, varies depending upon the shape and the type of the conveyor as well as the weights of the load and the pallet itself. Thus, the number of slip preventing members is determined in accordance with the manner of use of the pallet.

For example, where the slip preventing members are secured to the upper surface of the deck board, several members are provided near both ends of the deck board or 1 to 8 members are provided at an equal spacing over the entire surface of the deck board. It is also possible to mount the slip preventing members in the form of a grid (that is transversely and longitudinally). On the lower surface of the deck board 2 to 8 equally spaced slip preventing members are provided near the opposite ends of the deck board although their arrangement may be the same as on the upper surface. Where several equally spaced slip preventing members are provided near four sides of the deck board, it is not necessary to take into consideration the direction of mounting the pallet on a roller conveyor or the like.

Even when a single slip preventing member is provided along the center line of the pallet, slippage can be efficiently prevented.

The height of the slip preventing member above the deck board surface should be 0.5 to 3 mm, preverably 1 to 2 mm, although different depending upon the weight of the load and the physical characteristic of the slip preventing member.

If the number of the slip preventing members were small or if the height thereof were too high, they would be deformed excessively due to load or rollers of the conveyor thus making it difficult to slide the load on the pallet. This not only decreases workability but also increases resistance to the rollers. When the deformation is too large the pallet can not run along an inclined conveyor. For this reason, where the slip preventing members are mounted on the lower surface of the pallet it is desirable that they are deformed continuously by the conveyor rollers so that best result can be obtained when the slip preventing member are provided over the entire length of the pallet in a direction perpendicular to the axes of the rollers. Even when the slip preventing members are located discontinuously sufficient slip preventing effect can be manifested. If the members were too hard and too high, the pallet and load tend to vibrate.

The slip preventing members can be secured to the deck board by welding or an adhesive agent, but the former method is preferred because of its resistance to peel off.

Although the slip preventing members can be welded directly to the surface of the deck board, it is advantageous to form parallel grooves having a depth of about 1 to 2 mm in the surface of the deck board and to weld the slip preventing members to the bottoms of the grooves. Advantageously, the width of the grooves should be larger than that of the slip preventing members for the purpose of allowing deformation thereto.

Figure 2:
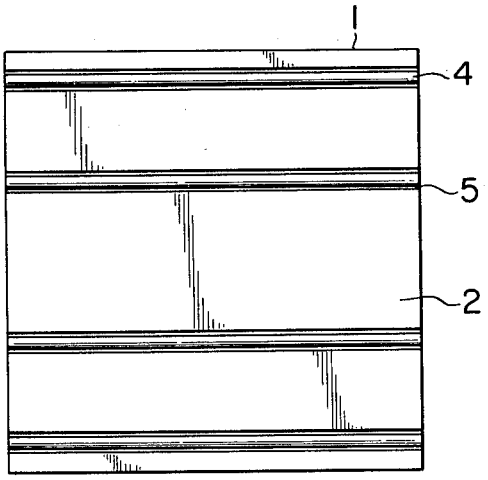
FIG. 2 is a plan view of the pallet shown in FIG. 1.
Figure 3:
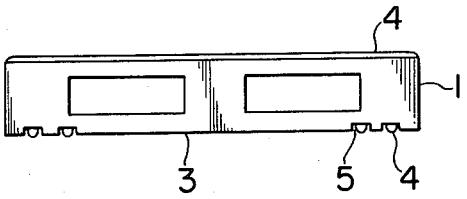
FIG. 3 is a side view of the pallet shown in FIG. 1.
Figure 4:
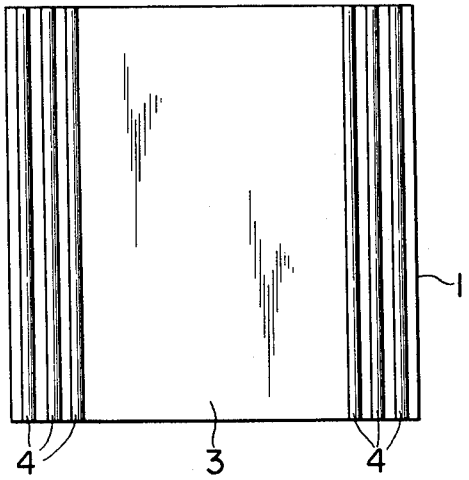
FIG. 4 is a bottom plan view of a modified embodiment of this invention.

The invention will now be described in detail with reference to the accompanying drawings. The synthetic resin pallet 1 shown in FIGS. 1, 2 and 3 is adapted to be supported by the forks of a fork lift (not shown) inserted into the pallet from either one of it two opposite sides. The pallet shown comprises a hollow rectangular moulded body. Since the construction of the pallet per se is immmaterial to this invention description thereof is believed unnecessary, except that it should be constructed to be light weight and rigid. In this example, the upper surface 2 and the lower surface 3 of the deck board are provided with grooves 5 and cord shaped slip preventing members 4 are welded to the bottoms of respective grooves 5. The slip preventing members 4 on the upper and lower surfaces extend at right angles. As above described, each slip preventing member must project beyond the upper or lower surface of the deck board. In a modified embodiment, a plurality of parallel slip preventing members are welded directly to the lower surface of the deck board.

Since the slip preventing members made of relatively soft and flexible material and having a predetermined thickness are welded to the upper and or lower surfaces of the deck board they deform when loaded with goods or contacted by conveyor rollers so that it is possible to prevent slippage of the load on the pallet or of the pallet on the rollers. When the pallet is caused to descend along inclined conveyor it is possible to control the descending speed of the pallet.

For this reason, the pallet of this invention is especially suitable for carrying relatively hard goods, such as crates containing bottles, petroleum cans and fiber drums, for example.

The following examples are given but it will be clear that the invention is not limited to these specific examples.

EXAMPLE 1

An ethylene-vinyl acetate copolymer (MI; 1.4, containing 14% by weight of vinyl acetate, and sold by Mitsui Polychemicals Co., Ltd. under a trade name of Evalfex) was extruded in the form of a sheet having a thickness of 2 mm which was slitted into ribbons having a width of 20 mm each. The ribbons were cut to form slip preventing members.

Four slip preventing members were welded by hot air to the bottoms of grooves having a depth of 1 mm each and formed on the upper surface of the deck board of a synthetic resin pallet (sold by Mitsubishi Kasei Kogyo Kabushiki Kaisha—also known as Mitsubishi Chemical Industries Ltd. under a trade name of "Palletec"), as shown in FIG. 1 to obtain a sample. For comparison, a plastic pallet not provided with slip preventing members and a wooden pallet were also prepared. The sample and these controls were tested as follows.

A crate (26 Kg) loaded with filled beer bottles was mounted on a pallet maintained horizontally and the angle (slip angle) at which the crate begins to slide was measured and the result is shown in the following Table 1.

TABLE 1

| pallet tested | slip angle |
|---|---|
| pallet of this invention | 27–28° |
| plastic pallet not provided with slip preventing member | 14–15° |
| wooden pallet | 24–25° |

As this Table shows, the slip angle of the pallet of this invention is larger than those of controls.

EXAMPLE 2

An extruded sheet of an ethylene-vinyl acetate copolymer prepared in the same manner as in Example 1 was cut into ribbons having a width of 10 mm each. A plurality of slip preventing members comprising the ribbons were welded to the bottoms of grooves provided for the lower surface of a pallet identical to that of Example 1 which was provided with slip preventing members on the upper surface of the pallet. The grooves had a depth of 1 mm and had an equal spacing of 20 mm. Slip preventing members of the number shown in the following Table 2 were welded at portions spaced 20 mm from both ends thereof.

A roller conveyor was set at an inclination of 21 (height): 1000 (horizontal) and 24 crates (total weight 630 kg) each loaded with filled beer bottles were mounted on the pallet and the pallet was mounted on the conveyor with the slip preventing members positioned at right angles with respect to the axes of the conveyor rollers. The time required for the pallet to descend over a distance of 4150 mm was measured to determine the slip preventing effect.

For comparison, the same measurement was also done for a synthetic resin pallet not provided with slip preventing members (sample A), a pallet made of wood dried indoor (sample B) and a pallet made of wood left in the outdoor to absorb moisture (sample C). The following Table 2 shows the result of measurement.

TABLE 2

| | Number of slip preventing member | descending time sec. | remark |
|---|---|---|---|
| this invention | 1 | 16.5 | Slip preventing member wad provided at the center |
| | 2 | 11.4 | |
| | 4 | 10.1 | |
| | 6 | 10.0 | |
| | 8 | 9.4 | |
| Sample | Sample A | 7.0 | |
| | B | 8.2 | |
| | C | 15.0 | |

The descending time of the wooden pallet varied considerably depending upon the condition of storing wood. In contrast, the descending time of the control sample A not provided with any slip preventing member is short so that when the pallet was stopped the crate was displaced greatly due to shock. This Table also shows that according to this invention it is possible to control the descending time by the number of the slip preventing members.

EXAMPLE 3

The following synthetic resins were prepared,

A. Low density polyethylene (MI., 0.5; density 0.925, sold by Mitsubishi Chemical Industries Co. under a trade name of "Nevatec-L"

B. Ethylene-ethylacrylate copolymer (MI. 6, sold by Nippon Unicar Co., Ltd. under a trade Name of "NUC ethylene copolymer EEA")

C. A mixture of 70 parts by weight of said low density polyethylene, 30 parts of an ethylene-vinyl acetate copolymer (MI, 2, content of vinyl acetate 25%, sold by Mitsui Polychemicals Co., Ltd. under a trade name of "Evaflex"

D. A mixture of 60 parts by weight of said low density polyethylene and 40 parts by weight of said ethylene-ethylacrylate copolymer, E. A mixture of 70 parts by weight of said low density polyethylene and 30 parts by weight of S—B—S type thermoplastic rubber (sold by Asahi Chemical Industry Co., Ltd. under a trade name of "Tufprene".

Each resin was extruded into a cord having an elliptical cross-section (thickness-3 mm, width 10 mm) and four slip preventing members made of the cord was welded to the grooves each having a depth of 1 mm and a width of 10 mm and provided on the lower surface of the synthetic resin pallet (identical to that used in Example 1 and provided with slip preventing members on the upper surface of the pallet). The slip preventing members were welded at the portion (excepting 20 mm on both ends of the deck board) at a spacing of 20 mm. The descending time of the pallets provided with the slip preventing members made of respective resins was measured in the same manner as in Example 2 and the result is shown in the following Table 3.

TABLE 3

| sample | descending time sec. |
|---|---|
| A | 9.0 |
| B | 10.8 |
| C | 9.7 |

TABLE 3-continued

| sample | descending time sec. |
|---|---|
| D | 10.2 |
| E | 9.5 |

Each sample has improved descending time when compared with plastic pallets not provided with slip preventing members.

We claim:

1. In a pallet made of a synthetic resin of the type comprising upper and lower deck boards, and a cord shaped slip preventing member made of relatively soft and flexible material and secured to at least one of the upper and lower deck boards of the pallet, at least one of said upper and lower deck boards being provided with a groove for receiving said slip preventing member, the improvement wherein said slip preventing member has a height larger than the depth of said groove so as to project beyond the deck board surface and the width of said groove is larger than that of said slip preventing member so that both sides of the slip preventing member are spaced from both side walls of said groove by a distance such that upon placing an object upon the pallet surface, the slip preventing member can deform in a direction parallel to the plane of the deck board surface to completely fill said groove so that the slip preventing member is able to compress in a direction transverse to the plane of the deck board surface sufficiently that the object may contact the pallet surface.

2. The pallet according to claim 1 wherein said slip preventing members are provided for the upper and lower surfaces of the deck board.

3. The pallet according to claim 1 wherein said slip preventing members are provided for the lower surface of the deck board near the opposite ends thereof.

4. The pallet according to claim 1 wherein said slip preventing member are welded to said deck board.

5. The pallet according to claim 1 wherein said pallet is made of polyolefin resin.

6. The pallet according to claim 5 wherein said polyolefin resin comprises a high density polyethylene.

7. The pallet according to claim 1 wherein said slip preventing member is made of relatively soft and flexible material consisting essentially of a polymer or a copolymer of ethylene.

8. The pallet according to claim 7 wherein the main component of the slip preventing member comprises a low density polyethylene.

9. The pallet according to claim 7 wherein the main component of the slip preventing member comprises an ethylene-vinyl acetate copolymer.

10. The pallet according to claim 9 wherein the content of the vinyl acetate of said ethylene-vinyl acetate copolymer is less than 30% by weight.

11. The pallet according to claim 7 wherein said slip preventing member is made of material consisting essentially of an ethylene-ethylacrylate copolymer.

12. The pallet according to claim 11 wherein the content of the ethylacrylate of said ethylene-ethylacrylate copolymer is less than 15% by weight.

13. The pallet according to claim 7 wherein said material is blended with thermoplastic rubber.

14. The pallet according to claim 1 wherein said slip preventing member projects beyond the surface of the deck board by 0.5 to 3 mm.

15. The pallet according to claim 1 wherein said slip preventing member has a rectangular cross-section with rounded corners.

16. The pallet according to claim 1 wherein said slip preventing member is welded to the bottom of said groove.

* * * * *